US005566855A

United States Patent [19]

Bradach

[11] Patent Number: 5,566,855

[45] Date of Patent: Oct. 22, 1996

[54] TIMED CIGARETTE CASE

[76] Inventor: Thomas L. Bradach, 24135 W. Willow Creek Rd., Kaycee, Wyo. 82639

[21] Appl. No.: 393,123

[22] Filed: Feb. 16, 1995

[51] Int. Cl.[6] ..... B65B 59/00

[52] U.S. Cl. ..... 221/15; 221/77

[58] Field of Search ..... 221/15, 76, 77, 221/248, 247, 135, 136; 206/242, 249, 256, 257

[56] References Cited

U.S. PATENT DOCUMENTS

| | | | |
|---|---|---|---|
| 2,681,560 | 6/1954 | Shuttleworth et al. | 70/273 |
| 2,819,814 | 1/1958 | Hatch | 221/15 |
| 3,363,439 | 1/1968 | Kende | 70/272 |
| 3,722,742 | 3/1973 | Wertz | 221/15 |
| 4,010,869 | 3/1977 | Adamo | 221/15 |
| 5,203,472 | 4/1993 | Levenbaum et al. | 221/15 |

*Primary Examiner*—Kenneth Noland
*Attorney, Agent, or Firm*—Michael I. Kroll

[57] ABSTRACT

A timed cigarette case comprising a housing having a compartment therein. A unit is for providing access to the compartment within the housing. A structure is rotatively mounted within the compartment of the housing, for storing a plurality of cigarettes therein. A facility is for operating the rotatively storing structure. An assembly is for actuating the operating facility at predetermined time intervals, so that one cigarette in the rotatively storing structure will be in position at the access unit to be removed therefrom.

12 Claims, 2 Drawing Sheets

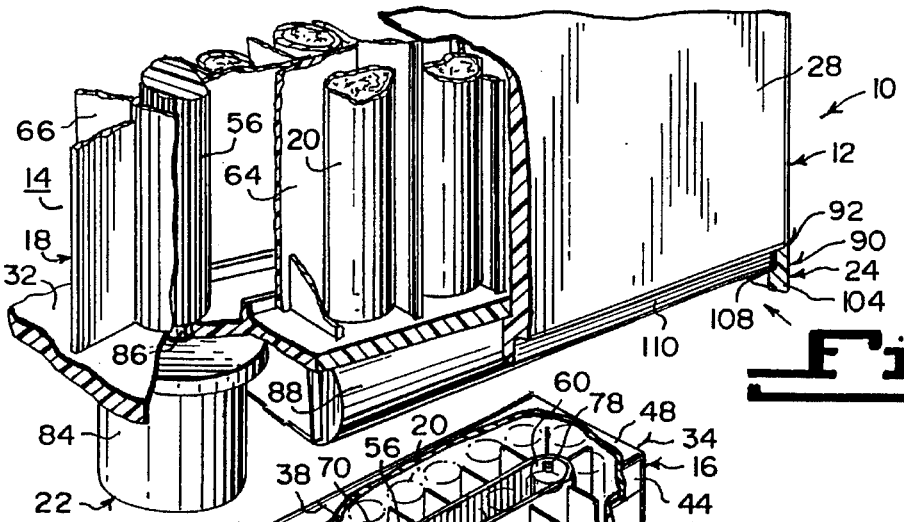
fig. 3
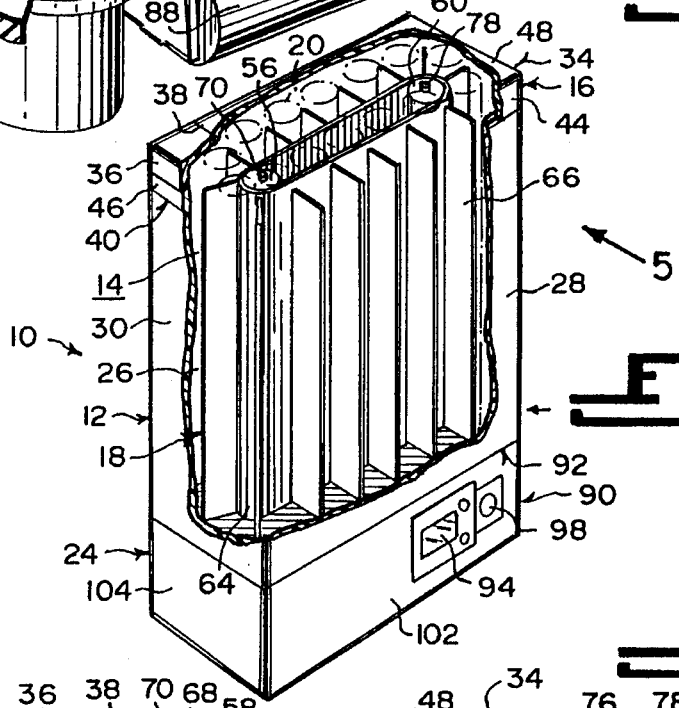
fig. 4
fig. 5
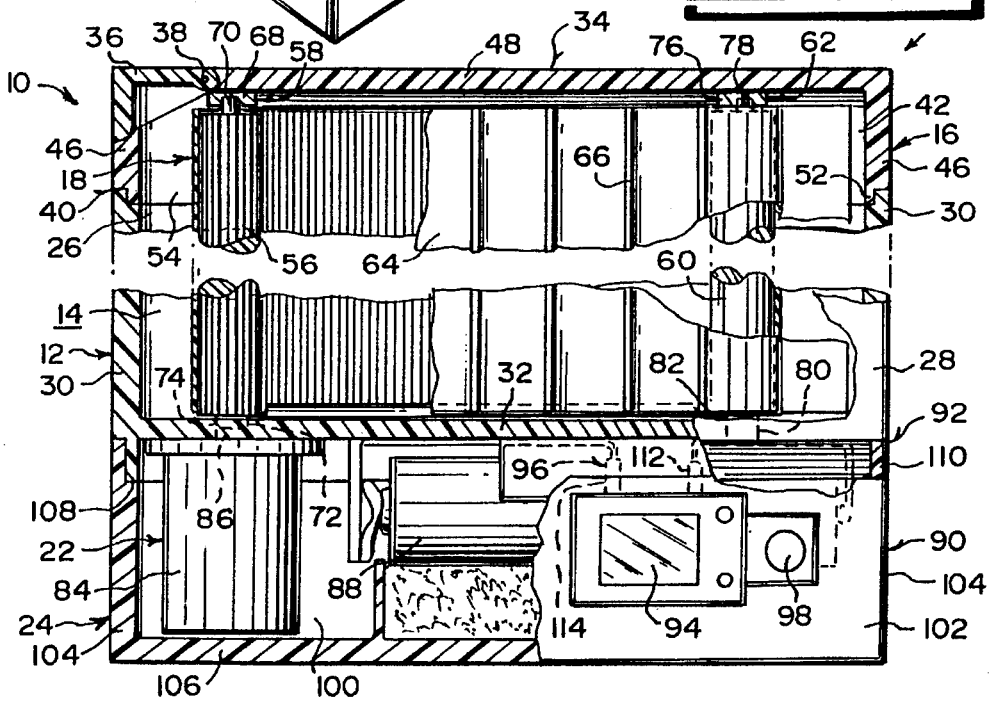

TIMED CIGARETTE CASE

BACKGROUND OF THE INVENTION

1. Field of the Invention

The instant invention relates generally to cigarette dispensers and more specifically it relates to a timed cigarette case.

2. Description of the Prior Art

Numerous cigarette dispensers have been provided in prior art. For example, U.S. Pat. Nos. 2,681,560 to Shuttleworth et al., 3,363,439 to Kende; 3,722,742 to Wertz and 5,203,472 to Levenbaum et al. all are illustrative of such prior art. While these units may be suitable for the particular purpose to which they address, they would not be as suitable for the purposes of the present invention as heretofore described.

SHUTTLEWORTH, VIVIAN CRAVEN

SEBERT, HARRY I.

CIGARETTE CASE HAVING A TIME-CONTROLLED LOCKING MEANS

U.S. Pat. No. 2,681,560

A cigarette case having a time-controlled locking means, comprises a case that provides a compartment therein for storing cigarettes. An opening into the compartment is to allow cigarettes to be inserted into or removed from the compartment. A closure for the opening is mounted, so that it can be moved to cover or uncover the opening. A latch secures the closure to the case, when the closure is in a closed position. The latch has a latch member movable from a locked to unlocked position, but is normally maintained in the locked position. The latch member has a shiftably mounted lever arm connected thereto. A rotatably mounted member has radially spaced camming projections thereon. A clock mechanism drives the rotatably mounted member at a uniform angular velocity. A camming means is actuated by the spaced projections and thereby actuates the lever arm sufficiently to move the latch member to the unlocked position. Cigarettes can be easily removed from the case at timed intervals, while their removal is hindered during the intervening periods.

KENDE, GEORGE

CIGARETTE CONTAINER WITH VARIABLE PERIOD TIME LOCK

U.S. Pat. No. 3,363,439

A time-lock cigarette container comprises a housing having a base defining therein a receptacle sized to receive a quantity of cigarettes. A cover is hingably connected to the base for movement into and out of closure relation to the receptacle. A latch means within the housing cooperates between the base and the cover for locking the cover in closure relation to the base. A timing means is operable for operating the latch means to unlock the cover a selected period following energization thereof. The timing means comprises a manually operable actuating means exteriorly of the housing, for actuating the timing means and for locking the latch means. The timing means is constructed so that the selected period is determined by the extent of operation of the actuating means. An adjustable selector means exteriorly of the housing cooperates with the actuating means for limiting to a selected amount the extent of operation of the actuating means. A trip means within the housing is operable at the end of the selected period for operating the latch means to unlock the cover.

WERTZ, KEITH J.

TIMED CIGARETTE DISPENSER

U.S. Pat. No. 3,722,742

A timed cigarette dispenser is disclosed which is operable to eject cigarettes one at a time at predetermined time intervals. The dispenser comprises a case having a compartment for containing a quantity of cigarettes. A tubular ejector is rotatingly mounted on the case for ejecting one cigarette from the compartment and blocking the passage of the others. The ejector is operatively connected, via a trip wire, to a slide which is transversely movable across the top of the casing. The manual movement of the slider is controlled by a timing mechanism which functions to periodically release the slider for election purposes. The slider is also operatively connected to a ratchet which is utilized as an automatic counter of the periodic time intervals. The ratchet preferably contains twenty teeth about its periphery, for providing twenty time interval counts for one revolution of the ratchet. The ratchet also includes a cam lever mounted thereon, which is adapted to trigger a locking mechanism for opening a cover to the case. The cam lever functions to unlock the case after each revolution of the ratchet, which is twenty time intervals, to enable the compartment to receive a new supply of cigarettes. The slider is also integrally connected to a gear rack, which is longitudinally slideable to engage an input gear of the timing mechanism for winding purposes. A time sequence cam is mounted adjacent the gear rack to adjustably limit the travel of the gear rack, thereby limiting the amount the timing mechanism can be wound.

LEVENBAUM, WARREN G.

ANDERSON, DAVID

TIMER CONTROLLED CIGARETTE DISPENSER

U.S. Pat. No. 5,203,472

A cigarette dispenser useful for aiding a person to stop smoking utilizes a movable belt for the controlled dispensing of cigarettes. The belt has openings therein which sequentially expose the open ends of cartridge compartments containing cigarettes to permit the cigarettes to be dispensed one at a time. A timing unit in the dispenser locks movement of the belt for periods of time during which the smoker is not permitted to smoke. Actual advancement of the belt is effected by the smoker at his leisure after receiving a signal signifying the end of the non-smoking period. The timing unit is in a controlled central processing unit capable of progressively increasing the duration of non-smoking periods during the course of the quitting routine.

SUMMARY OF THE INVENTION

A primary object of the present invention is to provide a timed cigarette case that will overcome the shortcomings of the prior art devices.

Another object is to provide a timed cigarette case that will help a smokers control of the number of cigarettes available to them and thus cut down on their smoking.

An additional object is to provide a timed cigarette case that will allow the removal of one cigarette from the case at timed intervals determined by a timer closing an electric circuit to allow a switch to operate a motor, which will in turn moves a finned conveyor belt, to position the cigarette within the case for proper removal therefrom.

A further object is to provide a timed cigarette case that is simple and easy to use.

A still further object is to provide a timed cigarette case that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein:

FIG. 3 is an enlarged rear perspective view of a portion thereof taken generally in the direction of arrow 3 in FIG. 2, with parts broken away and in cross section in an upright position.

FIG. 4 is a rear perspective view taken generally in the direction of arrow 4 in FIG. 1, with parts broken away and in cross section.

FIG. 5 is an enlarged rear elevational view taken generally in the direction of arrow 5 in FIG. 4, with parts broken away and in cross section.

Similar reference characters denote corresponding features consistently throughout the attached drawings.

DETAILED DESCRIPTION OF THE PREFERRED EMBODIMENTS

Figure 1:
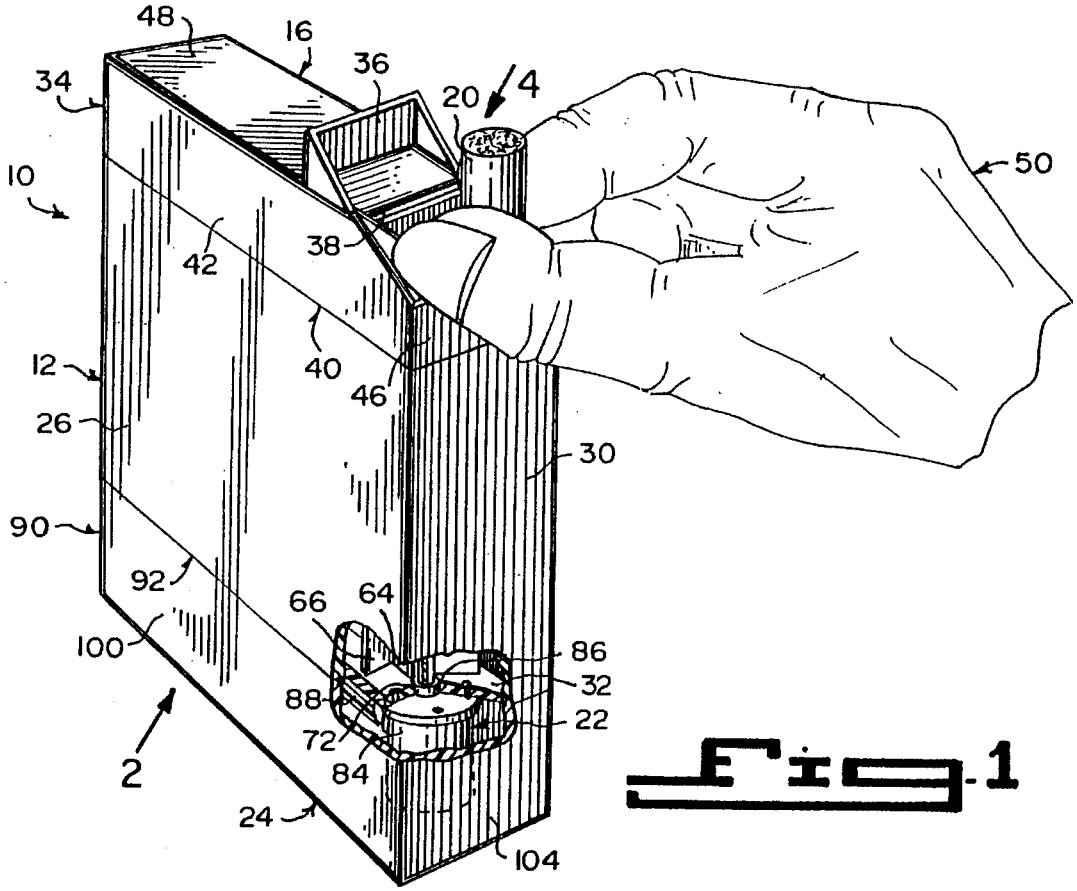
FIG. 1 is a front perspective view of the instant invention in an upright position with parts broken away, showing a hand of a person removing one cigarette therefrom.
Figure 2:
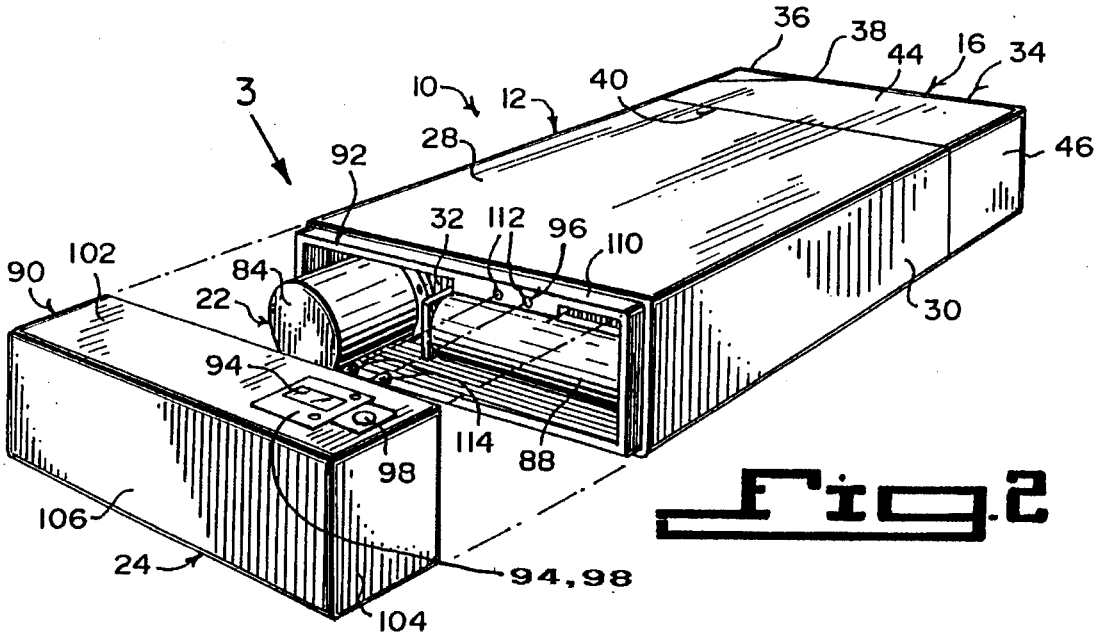
FIG. 2 is a rear perspective view taken generally in the direction of arrow 2 in FIG. 1, being in a horizontal position and showing the base exploded therefrom.

Turning now descriptively to the drawings, in which similar reference characters denote similar elements throughout the several views, FIGS. 1 through 5 illustrate a timed cigarette case 10 comprising a housing 12 having a compartment 14 therein. A unit 16 is for providing access to the compartment 14 within the housing 12. A structure 18 is rotatively mounted within the compartment 14 of the housing 12, for storing a plurality of cigarettes 20 therein. A facility 22 is for operating the rotatively storing structure 18. An assembly 24 is for actuating the operating facility 22 at predetermined time intervals, so that one cigarette 20 in the rotatively storing structure 18 will be in position at the access unit 16 to be removed therefrom.

The housing 12 includes a front wall 26 and a rear wall 28. Two side walls 30 extend between the front wall 26 and the rear wall 28. A bottom wall 32 is also provided, thereby forming the compartment 14 therein.

The access unit 16 consists of a top cover 34. A lid 36 is hinged at 38 to one side of the top cover 34. Equipment 40 is for connecting the top cover 34 to a top edge of the front wall 26, the rear wall 28 and the two side walls 30 of the housing 12.

The top cover 34 includes a front wall 42 and a rear wall 44. Two side walls 46 extend between the front wall 42 and rear wall 44. A top wall 48 is also provided. The lid 36 is angled with respect to the front wall 42, the rear wall 44 and one side wall 46 of the top cover 34. The lid 36 is hinged at 38 to the top wall 48 of the top cover 34. When the lid 36 is opened, a person 50 can reach in and grasp a top end of the cigarette 20 that is in position thereto, as shown in FIG. 1.

The top cover connecting equipment 40 consists of the top edge of the front wall 26, the rear wall 28 and the two side walls 30 of the housing 12 having a seat 52 thereabout. A bottom edge of the front wall 42, the rear wall 44 and the two side walls 46 of the top cover 34 has a flange 54 thereabout, to engage with the seat 52 in the housing 12.

The rotatively storing structure 18 includes an elongated gear shaft 56. Paraphernalia 58 is for positioning the elongated gear shaft 56 in a revolving manner between the bottom wall 32 of the housing 12 and the top wall 48 of the top cover 34, adjacent the lid 36. An elongated pulley shaft 60 is also provided. Paraphernalia 62 is for positioning the elongated pulley shaft 60 in a revolving manner between the bottom wall 32 of the housing 12 and the top wall 48 of the top cover 34 opposite from the elongated gear shaft 56. A continuous conveyor belt 64 extends about the elongated gear shaft 56 and, the elongated pulley shaft 60. A plurality of fins 66 are spaced apart on the conveyor belt 64, for storing the cigarettes 20 between the fins 66.

The elongated gear shaft revolving positioning paraphernalia 58 consists of a first bearing member 68 mounted to the underside of the top wall 48 of the top cover 34. A first top pin 70 on a top end of the elongated gear shaft 56 is rotatively carried in the first bearing member 68. The bottom wall 32 of the housing 12 has a first aperture 72 therethrough. A first bottom shaft 74 on a bottom end of the elongated gear shaft 56 is rotatively carried in the first aperture 72 in the bottom wall 32 of the housing 12.

The elongated pulley shaft revolving positioning paraphernalia 62 includes a second bearing member 76 mounted to the underside of the top wall 48 of the top cover 34. A second top pin 78 on a top end of the elongated pulley shaft 60, is rotatively carried in the second bearing member 76. The bottom wall 32 of the housing 12 has a second aperture 80 therethrough. A second bottom shaft 82 on a bottom end of the elongated pulley shaft 60 is rotatively carried in the second aperture 80 in the bottom wall 32 of the housing 12.

The operating facility 22 comprises an electric motor 84, mounted to the underside of the bottom wall 32 of the housing 12. The electric motor 84 has a drive shaft 86 coupled to the first bottom shaft 74 on the bottom end of the elongated gear shaft 56 in the first aperture 72 in the bottom wall 32 of the housing 12. A battery 88 is removably connected to the underside of the bottom wall 32 of the housing 12. The battery 88 is electrically connected to the electric motor 84.

The actuating assembly includes a base 90 with equipment 92 is for connecting the base 90 to a bottom edge of the front wall 26, the rear wall 28 and the two side walls 30 of the housing 12. A timer 94 is mounted in the base 90. Components 96 are for electrically coupling the timer 94 between the electric motor 84 and the battery 88. A push button switch 98 is mounted in the base 90 and is electrically connected to the timer 94.

The base 90 contains a front wall 100 and a rear wall 102. Two side walls 104 extend between the front wall 100 and the rear wall 102. A bottom wall 106 is also provided.

The base connecting equipment 92 consists of the top edge of the front wall 100, the rear wall 102 and the two side walls 104 of the base 90 having a seat 108 thereabout. A bottom edge of the front wall 26, the rear wall 28 and the two side walls 30 of the housing 12 has a flange 110 thereabout to engage with the seat 108 in the base 90.

The electrically coupling components 96 includes the bottom edge of the rear wall 28 of the housing 12 having a pair of socket holes 112. The top edge of the rear wall 102 of the base 90 has a pair of plug prongs 114, which engage with the socket holes 112.

LIST OF REFERENCE NUMBERS

10 timed cigarette case
12 housing of 10
14 compartment of 12
16 access unit of 10
18 rotatively storing structure in 14
20 cigarette in 18
22 operating facility of 10
24 actuating assembly of 10
26 front wall of 12
28 rear wall of 12
30 side wall of 12
32 bottom wall of 12
34 top cover
36 lid on 34
38 hinge of 36
40 top cover connecting equipment
42 front wall of 34
44 rear wall of 34
46 side wall of 34
48 top wall of 34
50 person
52 seat in 12
54 flange on 34
56 elongated gear shaft of 18
58 elongated gear shaft revolving positioning paraphernalia
60 elongated pulley shaft of 18
62 elongated pulley shaft revolving positioning paraphernalia
64 continuous conveyor belt between 58, 62
66 fin on 64
68 first bearing member of 58
70 first top pin on 56
72 first aperture in 32
74 first bottom shaft on 56
76 second bearing member of 62
78 second top pin on 60
80 second aperture in 32
82 second bottom shaft on 60
84 electric motor
86 drive shaft of 84
88 battery
90 base
92 base connecting equipment
94 timer in 90
96 electrically coupling components
98 push button switch in 90
100 front wall of 90
102 rear wall of 90
104 side wall of 90
106 bottom wall of 90
108 seat in 90
110 flange on 12

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A timed cigarette case comprising:

a) a housing having a compartment therein, said housing including a front wall, a rear wall, two side walls extending between said front wall and said rear wall, and a bottom wall, thereby forming said compartment therein;

b) means for providing access to said compartment within said housing, said access means including a top cover, a lid hinged to one side of said top cover, and means for connecting said tog cover to a top edge of said front wall, said rear wall and said two side walls of said housing;

c) means rotatively mounted within said compartment of said housing, for storing a plurality of cigarettes therein;

d) means for operating said rotatively storing means; and e) means for actuating said operating means at predetermined time intervals, so that one cigarette in said rotatively storing means will be in position at said access means to be removed therefrom.

2. A timed cigarette case as recited in claim 1, wherein said top cover includes:

a) a front wall;

b) a rear wall;

c) two side walls extending between said front wall; and d) a top wall.

3. A timed cigarette case as recited in claim 2, wherein said lid is angled with respect to said front wall, said rear wall and one side wall of said top cover and is hinged to said top wall of said top cover, so that when said lid is opened a person can reach in and grasp a top end of the cigarette in position thereto.

4. A timed cigarette case as recited in claim 3, wherein said top cover connecting means includes:

a) said top edge of said front wall, said rear wall and said two side walls of said housing having a seat thereabout; and b) a bottom edge of said front wall, said rear wall and said two side walls of said top cover having a flange thereabout to engage with said seat in said housing.

5. A timed cigarette case as recited in claim 4, wherein said rotatively storing means includes:

a) an elongated gear shaft;

b) means for positioning said elongated gear shaft in a revolving manner between said bottom wall of said housing and said top wall of said top cover, adjacent said lid;

c) an elongated pulley shaft;

d) means for positioning said elongated pulley shaft in a revolving manner between said bottom wall of said housing and said top wall of said top cover opposite from said elongated gear shaft;

e) a continuous conveyor belt extending about said elongated gear shaft and said elongated pulley shaft; and f) a plurality of fins spaced apart on said conveyor belt for storing the cigarettes between said fins.

6. A timed cigarette case as recited in claim 5, wherein said elongated gear shaft revolving positioning means includes:

a) a first bearing member mounted to the underside of said top wall of said top cover;

b) a first top pin on a top end of said elongated gear shaft rotatively carried in said first bearing member;

c) said bottom wall of said housing having a first aperture therethrough; and d) a first bottom shaft on a bottom end of said elongated gear shaft rotatively carried in said first aperture in said bottom wall of said housing.

7. A timed cigarette case as recited in claim 6, wherein said elongated pulley shaft revolving positioning means includes:

a) a second bearing member mounted to the underside of said top wall of said top cover;

b) a second top pin on a top end of said elongated pulley shaft, rotatively carried in said second bearing member;

c) said bottom wall of said housing having a second aperture therethrough; and d) a second bottom shaft on a bottom end of said elongated pulley shaft rotatively carried in said second aperture in said bottom wall of said housing.

8. A timed cigarette case as recited in claim 7, wherein said operating means includes:

a) an electric motor mounted to the underside of said bottom wall of said housing, said electric motor having a drive shaft coupled to said first bottom shaft on the bottom end of said elongated gear shaft in said first aperture in said bottom wall of said housing; and b) a battery removably connected to the underside of said bottom wall of said housing, said battery being electrically connected to said electric motor.

9. A timed cigarette case as recited in claim 8, wherein said actuating means includes:

a) a base;

b) means for connecting said base to a bottom edge of said front wall, said rear wall and said two side walls of said housing;

c) a timer mounted in said base;

d) means for electrically coupling said timer between said electric motor and said battery; and e) a push button switch mounted in said base and electrically connected to said timer.

10. A timed cigarette case as recited in claim 9, wherein said base includes:

a) a front wall;

b) a rear wall;

c) two side walls extending between said front wall and said rear wall; and d) a bottom wall.

11. A timed cigarette case as recited in claim 10, wherein said base connecting means includes:

a) said top edge of said front wall, said rear wall and said two side walls of said base having a seat thereabout; and b) a bottom edge of said front wall, said rear wall and said two side walls of said housing having a flange thereabout to engage with said seat in said base.

12. A timed cigarette case as recited in claim 11, wherein said electrically coupling means includes:

a) said bottom edge of said rear wall of said housing having a pair of socket holes; and b) said top edge of said rear wall of said base having a pair of plug prongs, which engage with said socket holes.

* * * * *